United States Patent [19]

Ito et al.

[11] Patent Number: 4,910,430

[45] Date of Patent: Mar. 20, 1990

[54] HIGH PRESSURE SODIUM LAMP SUBSTANTIALLY PREVENTING MOVEMENT OF MELTED SODIUM-MERCURY AMALGAM DURING USE

[75] Inventors: Akira Ito, Yokohama; Kenji Araki, Yokosuka; Kazuiki Uchida, Fujisawa, all of Japan

[73] Assignee: Kabushiki Kaisha Toshiba, Kawasaki, Japan

[21] Appl. No.: 60,443

[22] Filed: Jun. 11, 1987

[30] Foreign Application Priority Data

Mar. 6, 1987 [JP] Japan ..... 62-31879[U]

[51] Int. Cl.[4] ..... H01J 61/28; H01J 61/36

[52] U.S. Cl. ..... 313/566; 313/623

[58] Field of Search ..... 313/623, 625, 566, 574, 313/631, 285, 286, 565, 564

[56] References Cited

U.S. PATENT DOCUMENTS 4,065,691 12/1977 McVey ..... 313/625 X

FOREIGN PATENT DOCUMENTS 47-49383 12/1972 Japan .

OTHER PUBLICATIONS

"Interface Engineering", first edition issued on Dec. 20, 1986, published by Kyoritsu Publishing Co.

Electrical Engineering Materials, A. Dekker, Prentice-Hall, Inc., 1/59, pp. 15 and 16.

*Primary Examiner*—Kenneth Wieder

*Attorney, Agent, or Firm*—Oblon, Spivak, McClelland, Maier & Neustadt

[57] ABSTRACT

A high pressure sodium lamp includes a light permeable ceramic bulb wherein a pair of electrodes are oppositely arranged. One of the electrodes is inserted into one end of a metal tube, the other end of which is pinched. The center line average surface roughness of the inner surface of the metal tube is held below 2 μm for preventing melted sodium-mercury amalgam condensed on the inner surface of the other end of the metal tube from moving along the inner surface of the metal tube by capillary action toward the one end thereof.

7 Claims, 2 Drawing Sheets

HIGH PRESSURE SODIUM LAMP SUBSTANTIALLY PREVENTING MOVEMENT OF MELTED SODIUM-MERCURY AMALGAM DURING USE

BACKGROUND OF THE INVENTION

1. Field of the Invention

This invention relates, in general, to high pressure sodium lamps. More specifically, the invention relates to a high pressure sodium lamp which uses a translucent ceramic as a bulb with a pair of electrodes oppositely arranged, and a fill including a starting rare gas, mercury and sodium.

2. Description of the Prior Art

High pressure sodium lamps which use a translucent ceramic as a bulb are well known in the field of high efficiency discharge lamps. In such a lamp, the light permeable ceramic is made of a high density polycrystalline, such as alumina, or a metal oxide single crystal, such as ruby or sapphire.

In such a bulb using a translucent ceramic, since the ceramic has a high melting point, it is difficult to seal a pair of electrodes at the ends of the bulb in the normal manner by pinching the ends of the bulb under heat. In the case of aluminate ceramic, for example, sealing elements are used for sealing the opposite ends of the bulb through a glass solder. The sealing elements are made of the same material as the bulb, i.e., aluminate ceramic, or are made of a high melting point metal, such as, e.g., niobium and tantalum, whose thermal expansion coefficient is almost the same as the aluminate ceramic. A pair of electrodes are individually supported by each sealing element. More particularly, a metal tube made of, e.g., niobium, penetrates one of the sealing elements in an airtight relation, and one of the electrodes is fixed to the end of the metal tube which is positioned inside the bulb. During manufacture, the air in the bulb is exhausted through an exhausting hole in the metal tube, and the outer open end of the tube is sealed after the starting rare gas, excess amount of mercury and sodium are supplied to the bulb through the metal tube. Furthermore, the bulb comprising the construction described above is positioned in an outer envelope, the inside of which is held in a vacuous state.

In some of the lamps with the above-described construction, the lamp voltage thereof is sharply increased during lighting, and extinction of the arc between the electrodes occurs when the supply voltage is rapidly changed.

The inventors of the present invention discovered excess mercury and sodium condensed inside the metal tube in an inner area adjacent to the electrode and the exhaust hole. Since the outer end area ajdacent to the sealed outer end of the tube is the most cooled portion of the metal tube, such condensation normally should occur in that area. Therefore, the inventors concluded that the condensed sodium and mercury must have migrated from the outer area to the inner area.

Under the condition described above, since the temperature of the inner area of the metal tube is higher than that of the outer area of the metal tube, the mercury and sodium condensed in the inner area evaporate during lighting, and the vapor pressure of mercury and sodium in the bulb increases. In addition, sodium is easily reacted with the glass solder used as a sealing material, and alumina used as a bulb material, and thus it is consumed. As a result, the pressure of the mercury in the bulb partially increases, and thus the lamp voltage increases.

Next, the cause of the movement of mercury and sodium from the outer area of the tube toward the inner area of the tube will be discussed.

Materials which may be used for the metal tube of a sodium lamp are very limited. For example, the niobium commonly used for the tube is more difficult to process than iron, nickel or copper. As a result, a plurality of undesirable groove-shaped corrugations are produced, in the axis direction, on the inner surface of the metal tube during the manufacturing process. If excessive etching and annealing are used to remove these corrugations, the grain boundaries of the metal may appear on the inner surface of the tube after drawing, and as a result the inner surface of the tube may be too rough.

It is believed that a sodium-mercury amalgam condensed in the metal tube is melted into a fluid as the lamp is turned on. This fluid of sodium and mercury is believed to move toward the inner area of the tube (higher temperature portion) along the corrugations and the rough inner surface of the tube by capillary action.

SUMMARY OF THE INVENTION

It is an object of the present invention to extend the life of a high pressure sodium lamp.

It is another object of the present invention to substantially prevent the movement of a liquidized sodium-mercury amalgam in a metal tube of a high pressure sodium lamp.

It is a further object of the invention to stabilized the vapor pressure in a high pressure sodium lamp.

To accomplish the above objects, the high pressure sodium lamp of the present invention includes a light permeable ceramic bulb for containing a fill including a starting rare gas, sodium, and mercury, a pair of electrodes disposed opposite to one another at both ends of the bulb for producing an arc therebetween, and a metal tube for supporting one of the electrodes at one end thereof. The other end of the metal tube is sealed. The inside of the metal tube is opened to the inside of the bulb through an exhausting hole provided to the side wall of the metal tube.

The sodium and mercury in the bulb condense the sealed portion of the metal tube through the exhausting hole, and is melted during lighting of the lamp. The metal tube includes an inner wall having a surface roughness for substantially preventing movement of the melted sodium and mercury by capillary action along the inner wall.

The center line average surface roughness of the inner wall of the metal tube, at least in the vicinity of the sealed portion of the metal tube, is desirably held below 2 $\mu$m in order to substantially prevent the movement of the melted sodium and mercury.

The high pressure sodium lamp may includes a light permeable outer envelope for supporting the bulb therein.

BRIEF DESCRIPTION OF THE DRAWINGS

The present invention is best understood with reference to accompanying drawings in which.

DETAILED DESCRIPTION OF THE PREFERRED EMBODIMENT

The preferred embodiment of the present invention will now be described in more detail with reference to the accompanying drawings.

Figure 1:
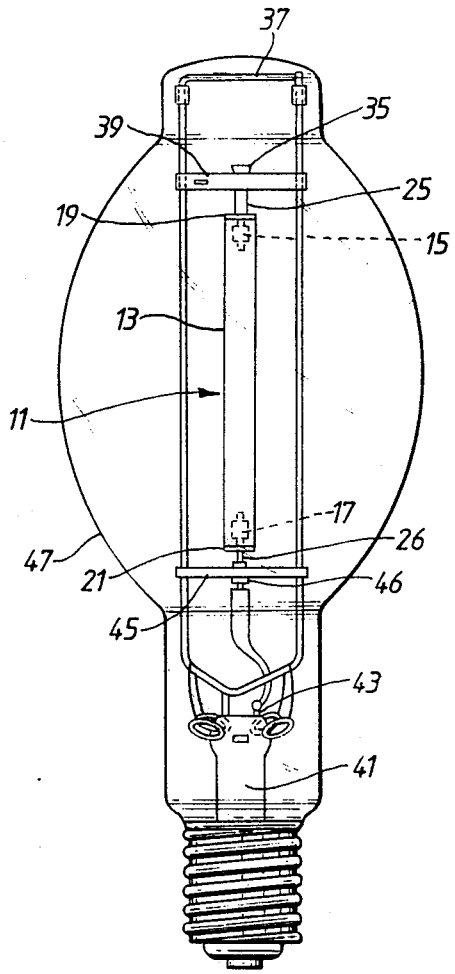
FIG. 1 is a side view illustrating a lamp according to an embodiment of the present invention.

FIG. 1 is a side view illustrating a high pressure sodium lamp. An arc tube 11 includes a bulb 13 and a pair of electrodes 15 and 17 individually disposed at each end of the bulb. Bulb 13 has a translucent ceramic envelope, such as, e.g., alumina-ceramic, containing a fill of a proper amount of starting rare gas, such as xenon, mercury and sodium. To seal the opposite ends of bulb 13 airtightly, a pair of plugs 19 and 21 made of alumina-ceramic are individually fixed to each end of bulb 13 by glass solder 23.

Figure 2:
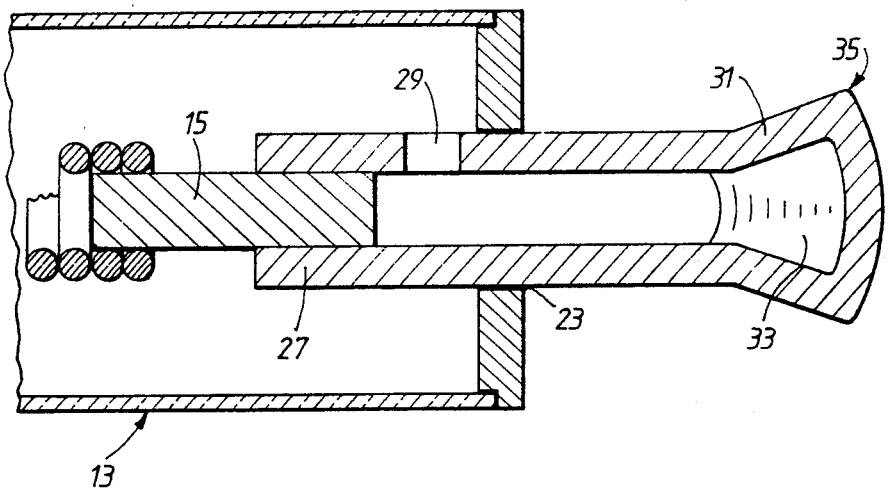
FIG. 2 is an enlarged vertical sectional view of a metal tube with one of the electrodes, as shown in FIG. 1.

A metal tube 25 made of niobium penetrates plug 19 and is fixed by glass solder 23 to the plug, as shown in FIG. 2.

One of the electrodes 15 is inserted into one end 27 of metal tube 25 disposed inside bulb 13, and the other electrode 17 disposed in bulb 13 is fixed to a lead wire 26 made of niobium. The lead wire 26 penetrates plug 21 and is fixed to plug 21 with the glass solder in an airtight state.

As shown in FIG. 2, an exhaust hole 29 is provided to the side wall of metal tube 25, which is disposed inside bulb 13, for the exhaust of the air in bulb 13 therethrough during manufacture.

As described above, a fill of starting rare gas, such as xenon, mercury and sodium is provided in bulb 13 through the other end 31 of metal tube 25 and exhausting hole 29. Mercury and sodium are supplied in excess to bulb 13 from the other end 31 of tube 25 through hole 29, as compared with the vaporized amount thereof needed for proper lighting. After bulb 13 is supplied with the fill, the other end 31 of metal tube 25 is pinched off or sealed, as shown in FIG. 2. During lighting of the lamp, the temperature in the vicinity of the end 31 of tube 25 is held lower than that of the end 27 thereof to which electrode 15 is supported. Therefore, a sodium-mercury amalgam 33 supplied in excess to bulb 13 is condensed on the inner surface of the other end 31 (pinched portion 35), as shown in FIG. 2. The end 31 of metal tube 25 is supported by a supporting rod 37 through a metal plate 39 firmly fixed to supporting rod 37. Supporting rod 37 is supported by a stem 41 so that a voltage can be applied to electrode 15 through supporting rod 37, metal plate 39 and metal tube 25.

One end of lead wire 26 is connected to electrode 17 and the other end thereof is connected to a lead 43 supported by stem 41. A voltage may be applied to electrode 17 through lead 43 and lead wire 26.

A metal plate 45 is welded to supporting rod 37. An insulating bushing 46 is fixed at the center of metal plate 45. Lead wire 26 penetrates insulating bushing 46, and is supported by metal plate 45 through insulating bushing 46. More specifically, lead wire 26 loosely penetrates insulating bushing 46 so that lead wire 26 may move in the axial direction thereof without rolling in excess. As a consequence, when bulb 13 expands in the axial direction thereof during lighting, lead wire 26 moves along insulating bushing 46 to absorb the expansion of bulb 13.

Arc tube 11 supported by supporting rod 37 is held in an outer envelope 47 made of hard glass. The construction described above is similar to that of conventional lamps.

FIG. 2 is an enlarged vertical longitudinal sectional view of the metal tube of the sodium lamp, as shown in FIG. 1. The inner surface of metal tube 25 is smoothed so that the center line average surface roughness (hereinafter referred to as a surface roughness) thereof is 0.8 μm. The surface roughness of the inner surface of metal tube 25 was measured by a surface roughness meter, Talysurf-6, made by Rank Taylor Hobson Leicester. The Talysurf-6 is equipped with a diamond tracing needle having a 90° point angle and a 2.5 μm point curvature thereof. The evaluation method of the measurement result is defined by section B 0601 of the JIS (Japanese Industrial Standard).

In the above-described construction, the sodium-mercury amalgam condensed on the inner surface of the end 31 of metal tube 25 is liquified with the temperature rise caused when the lamp is lit.

The liquified sodium-mercury amalgam moves from the end 31 of metal tube 25 to the end 27 thereof which is at a higher temperature than the end 31. The melted sodium-mercury amalgam moves along the inner surface of metal tube 25 by capillary action. However, in this embodiment, since the inner surface of metal 25 is smoothed, as described above, no capillary action occurs. Thus, the undesirable movement of the melted sodium-mercury amalgam in metal tube 25 may be prevented. Therefore, since undesirable vapor pressure rise of the fill in bulb 13, and excessive lamp voltage rise caused by the vapor pressure rise also are prevented, the undesired extinction of the lamp may be avoided.

In a comparison between each one hundred lamps of a conventional type and of the one embodiment described above, no extinction occurred in the lamps of the embodiment. On the other hand, four lamps were extinguished in the conventional lamps after 3000 hours of lighting.

In the mean time, the difference of surface roughness (Ra) of the inner surface of the metal tube depends on the manufacturing process of a tube material, for example rolling, extruding, drawing, annealing, and other processing, such as the Skin Pass method. In the Skin Pass method, a plastic deformation occurs only on the surface of the metal, and the grains of the surface of the metal thereby are refined for smoothing the surface thereof.

To carry out the observation, metal tubes were made by various kinds of these processes, as described above, and were classified by the surface roughness of the inner surface thereof.

One hundred lamps were individually manufactured with the classified metal tubes. The observations were carried out in two types of high pressure sodium lamps (70 W rating and 150 W rating). The results of the observations are shown in TABLES I and II, as follows.

TABLE I

| | (70 W) ON PERIOD (h) | | | | |
|---|---|---|---|---|---|
| | 0 | | 3,000 | | |
| | LAMP CHARACTER | | | | |
| | LAMP VOLTAGE | | LAMP VOLTAGE | | |
| SURFACE ROUGHNESS (Ra) μm | AVERAGE (Av) | FLUCTUATION (σ) | AVERAGE (Av) | FLUCTUATION (σ) | EXTINCTION |
| 0.3 | 90 | 4 | 89 | 5 | 0 |
| 0.5 | 89 | 4 | 89 | 5.5 | 0 |
| 1.0 | 91 | 4 | 90 | 5.5 | 0 |
| 2.0 | 93 | 5.5 | 97 | 7 | 0 |
| 3.0 | 94 | 6 | 99 | 9 | 3 |
| 4.0 | 97 | 6 | 107 | 13 | 5 |

TABLE II

| | (150 W) ON PERIOD (h) | | | | |
|---|---|---|---|---|---|
| | 0 | | 3,000 | | |
| | LAMP CHARACTER | | | | |
| | LAMP VOLTAGE | | LAMP VOLTAGE | | |
| SURFACE ROUGHNESS (Ra) μm | AVERAGE (Av) | FLUCTUATION (σ) | AVERAGE (Av) | FLUCTUATION (σ) | EXTINCTION |
| 0.3 | 90 | 4 | 91 | 5 | 0 |
| 0.5 | 90 | 4 | 90 | 5.5 | 0 |
| 1.0 | 89 | 4 | 90 | 5.5 | 0 |
| 2.0 | 91 | 5.5 | 92 | 7 | 0 |
| 3.0 | 93 | 5 | 97 | 9 | 2 |
| 4.0 | 95 | 6 | 104 | 12 | 3 |

As can be understood from TABLE I, the lamp voltage increases and the fluctuation (σ) thereof becomes greater, as the surface roughness (Ra) increases. The extinction occurs when the surface roughness (Ra) is more than 2 μm. As a consequence, when the surface roughness (Ra) of the inner surface of the metal tube is held below 2 μm, the lamp voltage barely increases even after the lamps are held ON for 3000 hours, and thus the extinction may be prevented.

In case of the 150 W rating lamp, a similar result to the 70 W rating lamp was observed from the TABLE II. In this case, the dispersion of the lamp voltage was small at the initial stage after the manufacturing thereof, in particular when the surface roughness (Ra) was held under 1 μm, as shown in TABLE II. Thus, high quality lamps of this type may be manufactured.

From the above-described results, regardless the input rating (W) of a lamp, a desirable lamp may be manufactured when the surface roughness of the inner surface of the metal tube is held under 2 μm. This result also was confirmed with lamps of this type having other ratings.

In the above-described embodiment, the metal tube is used only on one side of the bulb. However, the metal tube may be used on both sides of the bulb.

The entire inner surface of the metal tube is smoothed in the embodiment described above. However, only the inner portion of the metal tube in the vicinity of the condensed sodium-mercury amalgam may be smoothed. Furthermore, tantalum, and alloys of niobium or tantalum may be used as metal tube materials.

The present invention has been described with respect to a specific embodiment. However, other embodiments based on the principles of the present invention should be obvious to those of ordinary skill in the art. Such embodiments are intended to be covered by the claims.

What is claimed is:

1. A high pressure sodium lamp comprising:

a light permeable bulb means having opposite ends for containing a fill including a starting rare gas, sodium and mercury;

a pair of electrodes, one of each of said electrodes being disposed at each of the opposite ends of the bulb means for generating an arc therebetween through the fill; and hollow tube means for supporting one of the electrodes in the bulb means including a hollow chamber exposed to the fill and having an inner end and a sealed outer end, the other end being exposed to lower temperature than the inner end during operation of the lamp for condensing sodium-mercury amalgam to melt during operation of the lamp, the hollow chamber including an inner wall, the center line average surface roughness of which, at least in the vicinity of the outer end, is below about 2 μm, for substantially preventing movement of the melted sodium-mercury amalgam by capillary action toward the inner end.

2. A lamp according to claim 1, wherein the tube means includes an exhausting hole, the hollow chamber being opened into the inside of the bulb means through the exhausting hole for supplying the fill through the tube means to the bulb means during manufacture of the lamp.

3. A lamp according to claim 1 further including a lead wire means for supporting the other electrode inside the bulb means.

4. A lamp according to claim 1 further including supporting means for supporting the bulb means.

5. A lamp according to claim 4, wherein the supporting means includes a metal material, and the lamp further includes light permeable outer envelope means supporting the bulb means and the supporting means therein for preventing the metal material of the supporting means from being oxidized.

6. A high pressure sodium lamp comprising:

a pair of electrode means for producing an arc therebetween;

metal tube means having a closed end in which a sodium-mercury amalgam condenses and is melted when the electrode pair means is energized, the metal tube means supporting one of the electrode means, the metal tube means including inner wall means, a center line average surface roughness of which, at least in the vicinity of the closed end, is below about 2 μm, for substantially preventing movement of the melted sodium-mercury amalgam by capillary action along the inner wall means.

7. A lamp according to claim 6 further including a light permeable ceramic bulb means for containing a fill of starting rare gas, sodium, and mercury, the ceramic bulb means having opposite ends and one of the electrodes being disposed at each end.

* * * * *